US006627591B2

(12) United States Patent
Kuzmenka et al.

(10) Patent No.: US 6,627,591 B2
(45) Date of Patent: Sep. 30, 2003

(54) DYE FIXING COMPOSITION

(75) Inventors: Daniel Joseph Kuzmenka, Wood-Ridge, NJ (US); Diane Wolf, Bridgewater, NJ (US); Barbara Helen Bory, Fort Lee, NJ (US); Wakeelah Nai'Mah Muhammad, Newark, NJ (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 107 days.

(21) Appl. No.: 09/735,992

(22) Filed: Dec. 13, 2000

(65) Prior Publication Data

US 2002/0112294 A1 Aug. 22, 2002

Related U.S. Application Data

(60) Provisional application No. 60/172,421, filed on Dec. 17, 1999, now abandoned, and provisional application No. 60/229,201, filed on Aug. 31, 2000.

(51) Int. Cl.[7] ..... D06L 1/12

(52) U.S. Cl. ..... 510/276; 510/276; 510/327; 510/329; 510/330; 8/115.6

(58) Field of Search ..... 510/276, 329, 510/327; 8/115.6

(56) References Cited

U.S. PATENT DOCUMENTS

| | | | | |
|---|---|---|---|---|
| 4,756,849 | A | 7/1988 | Weber et al. | 252/542 |
| 5,632,781 | A | 5/1997 | Morinaga et al. | 8/442 |
| 5,804,543 | A | 9/1998 | Wertz et al. | 510/303 |
| 5,912,221 | A | 6/1999 | Van Leeuwen et al. | 510/360 |
| 6,127,329 | A * | 10/2000 | Baillely et al. | 510/320 |

FOREIGN PATENT DOCUMENTS

| | | |
|---|---|---|
| EP | 0 462 806 A2 | 12/1991 |
| WO | 97/28242 | 7/1997 |
| WO | 98/17758 | 4/1998 |
| WO | 99/27055 | 6/1999 |
| WO | 00/06680 | 2/2000 |
| WO | 00/15746 | 3/2000 |

* cited by examiner

*Primary Examiner*—Yogendra N. Gupta
*Assistant Examiner*—Eisa B Elhilo
(74) *Attorney, Agent, or Firm*—Alan A. Bornstein

(57) ABSTRACT

A composition comprising a dye fixing agent, a N-heterocyclic polymer, and a nonionic surfactant is described which provides improved fabric color care upon laundry treatment. A method of use is also described in conjunction with a detergent or in a presoak.

22 Claims, No Drawings

DYE FIXING COMPOSITION

This application claims the benefit of U.S. provisional application No. 60/172,421 filed Dec. 17, 1999 now abandoned; and No. 60/229,201 filed Aug. 31, 2000.

FIELD OF THE INVENTION

The present invention relates to compositions that provide care to the colors of fabrics in laundry treatment.

BACKGROUND OF THE INVENTION

The appearance of colored fabrics, e.g., clothing, bedding, household fabrics like table linens is one of the areas of concern to consumers. Indeed, upon typical consumer's uses of the fabrics such as wearing, washing, rinsing and/or tumble-drying of fabrics, a loss in the fabric appearance, which is at least partly due to loss of color shade intensity, fidelity and color definition, is observed. Such a problem of color loss is even more acute in laundry treatment after multiwash cycles, especially for dark colors, such as blacks, reds, blues, and greens.

Several mechanisms have been speculated upon for color loss and various means have been proposed to prevent or reduce the extent of the loss or transfer of color. For example, color fixatives, known in the dyeing industry have been proposed, as have agents (such as PVP) to hold color materials in solution to prevent re-deposition or to prevent abrasion between fibers. It has also been suggested to add bleaching agents to wash liquor to bleach any dye that enters solution.

One cause of color loss is the use of an inappropriate detergent composition. Thus, many manufacturers produce "color care" formulations that do not contain bleaches. Despite this, color damage remains a significant problem in the eyes of consumers.

WO 00/15746 (P&G), filed Sep. 15, 1998, published Mar. 23, 2000, discloses fabric care compositions, which comprise low molecular weight polyamines for color care. It is believed that the polyamines intercept peroxygen bleaching. A dye fixative may also be present in the compositions disclosed, as may an "abrasion reducing polymer" such as the N-heterocyclic polymer PVP (see examples 50–53 in table XII).

One aspect of the present invention is to provide a composition which provides improved color appearance of the laundered fabrics, especially after a single washing cycle and more especially after multiple wash cycles.

Applicants have surprisingly found that the combination of a dye fixing agent, an N-heterocyclic polymer, and a nonionic surfactant can be used as an additive in conjunction with a laundry detergent, or in a presoak step to solve the problem of dark color preservation.

SUMMARY OF THE INVENTION

One aspect of the present invention is a composition comprising a dye fixing agent, an N-heterocyclic polymer, and a nonionic surfactant. Preferably a chelating compound is added to reduce color shifting, especially for the reduction of bluing of direct red dyes when tap water containing dissolved metals such as iron, copper, and the like is used.

In another aspect of the invention, there is provided a method for providing color care to fabrics upon domestic laundering treatments which comprise the step of contacting the fabrics with the inventive composition, either in the presence of detergent or in a presoak step without detergent.

In a further aspect of the invention, improvement in color shade stability and dye transfer is observed for treated fabrics, especially direct-dyed, cellulosic dark colored fabrics, even if the water temperature of the treatment is varied from cold (60 F) to hot (130 F). Direct dyed cellulosic fabrics (e.g. cotton, rayon, etc.) show substantially improved color shade retention and minimal dye transfer with the inventive composition.

DETAILED DESCRIPTION

The inventive fabric care composition comprises a dye fixing agent, an N-heterocyclic polymer, and a nonionic surfactant dissolved in water, a water miscible solvent, or a blend thereof. The inventive composition may also be in the form of a semisolid, powder or granule which is dissolved in an aqueous medium when ready for use. In the liquid state, preferably the dye fixing agent is present in the concentration range of 0.1 to 20 wt. %, more preferably in the concentration range of 1 to 10 wt. %. Preferably the N-heterocyclic polymer is present in the concentration range of 0.01 to 10 wt. %, more preferably in the concentration range of 0.1 to 5 wt. %.

Preferably the inventive fabric care composition further comprises a chelating agent. Preferably the chelating agent is present in the concentration range of 0.005 to 5 wt. %, more preferably in the concentration range of 0.05 to 1 wt. %. Preferably the inventive fabric care composition further comprises a nonionic surfactant. Preferably the nonionic surfactant is present in the concentration range of 0.01 to 20 wt. %, more preferably in the concentration range of 0.1 to 10 wt. %.

The inventive fabric care composition preferably contains a buffering agent to adjust the pH in the range of 7.0 to 8.5, and various adjuvants such as one or more preservatives, colorants, fragrances, and the like.

An inventive process for pretreating colored fabrics with the inventive composition is also provided which comprises the steps of presoaking the fabric by applying said composition onto the fabric in a sufficient quantity of water to wet the fabric, and allowing said composition to remain in contact with said fabric before said fabric is washed for a predetermined time as indicated below. Preferably the dye fixing agent is present in the concentration range of about 0.0008 to 0.16 wt. %, more preferably in the concentration range of about 0.008 to 0.08 wt. % in the presoak solution. Preferably the N-heterocyclic polymer is present in the concentration range of about 0.00008 to 0.08 wt. more preferably in the concentration range of about 0.0008 to 0.04 wt. % in the presoak solution. Preferably a chelating agent is present in the concentration range of about 0.00004 to 0.04 wt. %, more preferably in the concentration range of about 0.0004 to 0.008 wt. % in the presoak solution. Preferably the presoak time is in the range of about 10 minutes to 12 hours, more preferably about 10 to 60 minutes. Typically the presoak temperature is in the range of about 60 F to 90 F.

The presoak solution more preferably contains a buffering agent to adjust the pH in the range of 7.0 to 8.5 and various adjuvants such as one or more preservatives, colorants, fragrances, and the like.

An inventive process for washing colored fabrics with the inventive composition is also provided comprising the steps of adding said composition into a detergent solution for washing fabrics where said detergent solution has a concentration of surfactants in the range of about 1.0 to 0.08 wt %.

Useful detergent products typically have a concentration of surfactants in the range of about 20 to 40 wt %. Preferably the detergent surfactants includes at least one anionic surfactant selected from sodium alkyl ethoxy sulfate, sodium alkyl benzene sulfonate, primary alcohol sulfates, and the like and which are collectively present in a concentration range of about 10 to 30 wt. %.

Preferably the dye fixing agent is present in the concentration range of about 0.0001 to 0.02 wt. %, more preferably in the concentration range of about 0.001 to 0.01 wt. % in the washing solution. Preferably the N-heterocyclic polymer is present in the concentration range of about 0.00001 to 0.01 wt. %, more preferably in the concentration range of about 0.0001 to 0.005 wt. % in the washing solution. Preferably a chelating agent is present in the concentration range of about 0.000005 to 0.005 wt. %, more preferably in the concentration range of about 0.00005 to 0.001 wt. % in the washing solution.

The washing solution preferably contains a buffering agent to adjust the pH in the range of 7.0 to 9.5, and various adjuvants such as one or more preservatives, colorants, fragrances, and the like.

Dye Fixing Agents

A component of the inventive composition is a dye fixing agent. Dye fixing agents, or "fixatives", are well-known, commercially available materials which are designed to improve the appearance of dyed fabrics by minimizing the loss of dye from fabrics due to washing. Not included within this definition are components which are fabric softeners.

Many dye fixing agents are cationic, and are based on various quaternized or otherwise cationically charged organic nitrogen compounds. Cationic fixatives are available under various trade names from several suppliers. Representative examples include: Tinofix CL, ECO, RTM, and RTM.FRD from Ciba-Geigy, Burcofix NF and Burcoterg from Burlington Chemical; Mirapol A-15 from Rhodia; CROSCOLOR PMF (July 1981, Code No. 7894) and CROSCOLOR NOFF (January 1988, Code No. 8544) from Crosfield; INDOSOL E-50 (Feb. 27, 1984, Ref. No. 6008.35.84; polyethyleneamine-based) from Sandoz such as SANDOFIX TPS, and SANDOFIX SWE (cationic resinous compound), REWIN SRF, REWIN SRF-O and REWIN DWR from CHT-Beitlich GMBH.

Other cationic dye fixing agents are described in "After-treatments for improving the fastness of dyes on textile fibres" by Christopher C. Cook (REV. PROG. COLORATION Vol. 12, 1982). Dye fixing agents suitable for use in the present invention are ammonium compounds such as fatty acid-diamine condensates e.g. the hydrochloride, acetate, metasulphate and benzyl hydrochloride of oleyldiethyl aminoethylamide, oleylmethyldiethylenediaminemethosulphate, monostearylethylene diaminotrimethylammonium methosulphate and oxidized products of tertiary amines; derivatives of polymeric alkyldiamines, polyaminecyanuric chloride condensates and aminated glycerol dichlorohydrins.

A typical amount of the dye fixing agent to be employed in the composition of the invention is preferably up to 90% by weight, preferably up to 50% by weight, more preferably from 0.1% to 20% by weight, most preferably from 1% to 10% active by weight of the composition.

N-Heterocyclic Polymers

A second component of the present invention is an N-heterocyclic polymeric dye transfer inhibiting agent. Such polymeric dye transfer inhibiting agents are normally incorporated into detergent compositions in order to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash. Not included within this definition are components which are fabric softeners.

Especially suitable polymeric dye transfer inhibiting agents are PVP N-oxide polymers, copolymers of N-vinylpyrrolidone and N-vinylimidazole, polyvinylpyrrolidone polymers, polyvinyloxazolidones and polyvinylimidazoles, 4-vinyl pyridine polymers, 2-vinyl pyridine polymers or mixtures thereof, and the like. Such polymers may or may not be quaternized. Useful polymeric dye transfer inhibiting agents are described in U.S. Pat. No. 5,849,684; issued on Dec. 15, 1998 to Donoghue, et al. which is here incorporated by reference. Preferably an alkali metal or ammonium salt of Poly (N-carboxymethyl-4-vinylpyridinium) chloride such as the sodium salt, obtainable as Chromabond S-100 from ISP Chemical Corp.; or PVP homopolymer obtainable from BASF Chemical Corp. may be used.

Chelating Agents

The inventive composition may also optionally contain one or more transition-metal selective sequestrants or "chelating agents", e.g., iron and/or copper and/or manganese chelating agents, provided that such materials are compatible or suitably formulated. Chelating agents suitable for use herein can be selected from the group consisting of aminocarboxylates, iminodisuccinates, hydroxycarboxylates (especially citrates), phosphonates (especially the aminophosphonates), polyfunctionally-substituted aromatic chelating agents, phosphates, and mixtures thereof. Without intending to be bound by theory, it is believed that the benefit of these materials is due in part to their exceptional ability to remove iron, copper and manganese ions from washing solutions by formation of soluble chelates. Commercial chelating agents for use herein include iminodisuccinate TP© from Bayer; DEQUEST™ series, and chelants from Monsanto, DuPont, and Nalco, Inc.

Aminocarboxylates useful as optional chelating agents are further illustrated by ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts thereof. Polyfunctionally-substituted aromatic chelating agents are also useful in the compositions herein. See U.S. Pat. No. 3,812,044, issued May 21, 1974, to Connor et al. and U.S. Pat. No. 6,099,587, issued Aug. 8, 2000 to Scialla et al.; both of which are here incorporated by references for further useful examples.

Aminophosphonates are also suitable for use as chelating agents in the compositions of the invention when at least low levels of total phosphorus are permitted in detergent compositions, and include the ethylenediaminetetrakis (methylenephosphonates) and the diethylenetriaminepentakis (methylenephosphonates). If utilized, chelating agents or transition-metal-selective sequestrants will preferably comprise from about 0.001% to about 10%, more preferably from about 0.05% to about 1% by weight of the compositions herein.

Carboxymethyloxy succinates, and alkali metal, ammonium, substituted ammonium and alkanolamine salts thereof are also suitable for use as chelating agents in the composition of the invention. See U.S. Pat. No. 3,692,685, issued Sep. 19, 1972 to Lamberti et al., which is here incorporated by reference.

Nonionic Surfactants

A third component of the inventive fabric care composition is a nonionic surfactant. One class of nonionic surfactants useful in the present invention are condensates of ethylene oxide with a hydrophobic moiety to provide a surfactant having an average hydrophilic-lipophilic balance (HLB) in the range from 8 to 17, preferably from 8.5 to 13.5, more preferably from 10 to 13.3. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the C9–C15 primary alcohol ethoxylates containing 3–10 moles of ethylene oxide per mole of alcohol, particularly the C12–C15 primary alcohols containing 6–9 moles of ethylene oxide per mole of alcohol and the C12–C14 primary alcohols containing 5–9 moles of ethylene oxide per mole of alcohol.

Another class of nonionic surfactants comprises alkyl polyglucoside compounds of general formula RO (Cn H2n O)t Zx wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergents are disclosed in U.S. Pat. No. 4,536,317 issued on Aug. 20, 1985 to Llenado et al.; U.S. Pat. No. 4,483,779 issued on Nov. 20, 1984 to Llenado et al.; and U.S. Pat. No. 4,493,773 issued on Jan. 15, 1985; all of which are here incorporated by reference.

Also suitable as nonionic surfactants are poly hydroxy fatty acid amide surfactants of the formula R2(CO)N(R1)Z wherein R1 is H, or R1 is C1–4 hydrocarbyl, 2-hydroxy ethyl, 2-hydroxy propyl or a mixture thereof, R2 is C5–31 hydrocarbyl, and Z is a polyhydroxyhydrocarbyl having a linear hydrocarbyl chain with at least 3 hydroxyls directly connected to the chain, or an alkoxylated derivative thereof. Preferably, R1 is methyl, R2 is a straight C11–15 alkyl or alkenyl chain such as coconut alkyl or mixtures thereof, and Z is derived from a reducing sugar such as glucose, fructose, maltose, lactose, in a reductive amination reaction.

Other suitable nonionic surfactants include long chain amine oxides, long chain phosphonic oxides, and dialkyl sulfoxides.

Fabric Evaluation Methods

The color care benefit with regard to shade stability and color shifting may either be assessed visually by a trained panel or by determination of the so-called delta-E values, or by other art recognized techniques.

When visual assessment is used, a panel of expert graders visually compare fabrics treated with and without the composition according to the present invention and variations thereof. Each panelist assigns 5 points for the least faded example, 4 points for the next best, and so on when 5 samples are being compared. The rank scores for all the panelists are then summed and compared with each other. The maximum points to be assigned is set to equal the number of samples to be compared.

Other useful methods for the assessment of the color care benefit to fabrics is the determination of the so-called delta-E values. Delta E's are defined, for instance, in ASTM D2244. Delta E is the computed color difference as defined in ASTM D2244, i.e. the magnitude and direction of the difference between two psychophysical color stimuli defined by tristimulus values, or by chromaticity coordinates and luminance factor, as computed by means of a specified set of color-difference equations defined in the CIE 1976 CIELAB opponent-color space, the Hunter opponent-color space, the Friele-Mac Adam-Chickering color space or any equivalent color space.

Except in the operating and comparative examples, or where otherwise explicitly indicated, all numbers in this description indicating amounts of material ought to be understood as modified by the word "about".

The following examples will more fully illustrate the embodiments of this invention. All parts, percentages and proportions referred to herein and in the appended claims are by weight unless otherwise illustrated.

The following Heavy Duty Liquid (HDL) Detergent formulations were tested with the inventive composition as follows:

HDL A

| Component | WT. % |
|---|---|
| ALKYL ETHER SULPHATE, SODIUM SALT | 19.1 |
| PROPYLENE GLYCOL | 8.6 |
| SODIUM CITRATE DIHYDRATE | 5.2 |
| ETHANOL | 3.1 |
| SOAP, MONOETHANOLAMINE, SALT | 2.4 |
| SODIUM CUMENESULFONATE | 2.4 |
| ALCOHOL ETHOXYLATE 7–9 EO | 2.3 |
| ALKYL GLUCOSAMIDE | 2.2 |
| MONOETHANOLAMINE | 1.0 |
| BORIC ACID | 0.7 |
| ETHOXYLATED AMINE | 0.6 |
| FLUORESCENT WHITENING AGENT 'PL' | 0.15 |
| SILICONE | 0.01 |
| WATER | 50.4 |
| PROTEASE | 0.76 |
| AMYLASE | 0.15 |
| LIPASE | 0.094 |
| CAREZYME | 0.06 |
| PERFUME | 0.15 |

HDL B

| Ingredient | Function | Percentage |
|---|---|---|
| Sodium alkylbenzenesulfonate | Anionic Surfactant | 16 |
| Alcohol Ethoxylate 9EO | Nonionic Surfactant | 5.5 |
| Sodium Silicate | pH buffering agent | 3.2 |
| Sodium xylenesulfonate | Hydrotrope | 1.3 |
| Fragrance | Perfume | 0.25 |
| Sodium stearate | Soap/foam control agent | 0.13 |
| Tinopal 5BM-GX | Fluorescent whitening agent | 0.1 |
| Water | | To 100% |

HDL C

| Ingredient | Function | WT % |
|---|---|---|
| Sodium alkylbenzenesulfonate | Anionic Surfactant | 6.0 |
| Alcohol Ethoxylate 9EO | Nonionic Surfactant | 6.6 |
| SodiumAlcohol Ethoxysulfate | Anionic Surfactant | 10.5 |
| Monoethanolamine cocoate | Soap | 1.0 |
| Sodium Citrate | Builder | 3.2 |
| Propylene glycol | Enzyme stabilization system | 4.75 |
| Sorbitol | Enzyme stabilization system | 3.25 |
| Sodium Borate pentahydrate | pH buffer | 2.1 |

-continued

| HDL C | | |
|---|---|---|
| Ingredient | Function | WT % |
| Tinopal UNPA | Fluorescent whitening agent | 0.2 |
| Acrylic acid styrene copolymer | Soil release polymer | 0.3 |
| Fragrance | Perfume | 0.2 |
| Properase | Proteolytic enzyme | 0.3 |
| Lipolase | Lipolytic enzyme | 0.4 |
| Water | | To 100% |

EXAMPLE 1

The effect of a one wash anti-dye fading benefit for the inventive formulations was examined under hot water conditions. The testing methodology involved washing direct dyed bleeder test cloths in a Tergotometer with inventive solutions plus detergent as described below and then allowing a panel to evaluate the cloths versus unwashed test cloths and cloths washed in a detergent alone for comparative dye fading results.

Initial screening experiments tested the performance of the four dye fixatives on Direct Red 80 test cloths vs a comparative case without a dye fixative and an N-heterocyclic polymer. The dye fixatives were delivered by the inventive solution with or without N-heterocyclic polymers as an anti-dye transfer agent. HDL A was chosen as the main wash detergent and 90 F warm water washing conditions were used. These conditions were chosen to maximize the possibility of seeing the anti-fading benefit. Rank sums were used to evaluate the panelist data as described below from twenty trained panelists. Higher scores indicate better dye fixative performance. The results are summarized in Table I.

TABLE 1

| Test Product | Rank Sum Score |
|---|---|
| Comparative | 53 |
| Tinofix (PVP) | 101 |
| Burcofix (PVP) | 104 |
| Mirapol A-15 (PVP) | 58 |
| Tinofix (NO PVP) | 137 |
| Burcofix (NO PVP) | 88 |
| Mirapol A-15 (NO PVP) | 34 |

In general the anti-fading results were generally good even though dark colored clothes were washed in hot water. These washes were repeated using cold water conditions (60 F). The results, from 18 panelists, are shown in Table 2

TABLE 2

| Product | Direct Red (80) | Direct Black (22) | Direct Green (26) | Overall score |
|---|---|---|---|---|
| Comparative | 38 | 91 | 76 | 205 |
| Tinofix (PVP) | 117 | 115 | 116 | 348 |
| Burcofix (PVP) | 65 | 119 | 128 | 312 |
| Mirapol A-15 (PVP) | 60 | 108 | 72 | 240 |
| Tinofix (NO PVP) | 137 | 115 | 99 | 351 |
| Burcofix (NO PVP) | 85 | 87 | 62 | 234 |
| Mirapol A-15 (NO PVP) | 68 | 93 | 127 | 288 |

Experimental Details
Inventive Formulation
In order of addition

| COMPONENT | % WEIGHT |
|---|---|
| SodiumBorate Pentahydrate | 1.0 |
| Acid Blue 80 | 0.003 |
| Alcohol Ethoxylate, 9EO | 5.0 |
| Polyvinyl pyrolidone | 0.5 |
| Kathon preservative | 0.0003 |
| EDTA or IDS | 0.1 |
| Perfume | 0.2 |
| Dye fixative | 2.5; 5.0; and 10.0% |
| Zeolite Water | To 100% |

| | |
|---|---|
| Wash conditions: | Tergotometer (manufactured by US Testing Co., Hoboken NJ)<br>Water: 120 ppm hardness (2:1 $Ca^{2+}/Mg^{2+}$)<br>14 minute wash and 2 minute rinse<br>Tumble dry<br>90F.<br>3 Direct Red 80 cloths and 3 white cloths/pot |
| Detergent product: | Detergents HDL A or B at 1.63 g/liter dose<br>Inventive formulation at 1.18 g/liter doses<br>The detergent and Inventive formulation were added simultaneously |
| Assessment: | Direct dyed cloths (Direct Red 80; Direct Black 22; and Direct Green 26) were ranked from best to worst compared to unwashed cloths using a Rank Sum method by a trained panel. Each panelist assigned 5 points for the least faded example, 4 points for the next best, and so on. The rank scores for all the panelists were then summed. |

EXAMPLE 2

The effect of the combination of HDL B detergent and the embodiment of the inventive composition illustrated in Example 1 (using Tinofix ECO as the dye fixative and polyvinyl pyrolidone as the N-heterocyclic polymer) on anti-dye fading benefits was assessed. The other washing conditions were identical to those used in Example 1. This data is shown in Table 3.

TABLE 3

| Dye fixative performance with HDL B | |
|---|---|
| Product | Rank Sum scores |
| Red cloths | |
| Comparative | 20 |
| Tinofix ECO/PVP | 48 |
| Black cloths | |
| Comparative | 25 |
| Tinofix ECO/PVP | 51 |
| Green cloths | |
| Comparative | 32 |
| Tinofix ECO/PVP | 51 |
| Overall scores | |
| Comparative | 77 |
| Tinofix ECO/PVP | 150 |

EXAMPLE 3

The effect of dye fixative level and chelating agents on the performance of the inventive product regarding anti-fading properties was studied. Chelating agents such as EDTA (ethylenediamine tetracetate) and IDS (iminodisuccinate) were also added to prevent the changing of red color shade (bluing) by the metal ions that are naturally found in tap water so that any influence of color shade variation on dye fading assessment on the red test cloths would be reduced.

Tinofix ECO was tested at 5% and 2.5% versus HDL A and B liquids at low wash temperature conditions (60 F). Panelists visually assessed both Direct Red and Direct Black test cloths. The results are tabulated in tables 4 and 5 respectively.

TABLE 4

Dye fixative performance at 5% level.

| Product | HDL A Detergent | HDL B Detergent |
|---|---|---|
| Red | 22 | 30 |
| Comparative Tinofix ECO/PVP | 43 | 59 |
| Black | 33 | 27 |
| Comparative Tinofix ECO/PVP | 43 | 49 |
| Overall | 55 | 57 |
| Comparative Overall Tinofix ECO/PVP | 86 | 108 |

TABLE 5

Dye fixative performance at 2.5% level

| Product | HDL A Detergent | HDL B Detergent |
|---|---|---|
| Red | 24 | 30 |
| Comparative Tinofix ECO/PVP | 44 | 40 |
| Black | 23 | 21 |
| Comparative Tinofix ECO/PVP | 27 | 33 |
| Overall | 47 | 51 |
| Comparative Overall Tinofix ECO/ | 71 | 73 |

EXAMPLE 4

Washing Machine Experiments

The performance of an embodiment of the inventive composition based on Tinofix ECO and Chromobond S-100 was assessed. The testing conditions are as follows:

Inventive Formulation Embodiment

| COMPONENT | FUNCTION | WEIGHT % |
|---|---|---|
| Sodium Borate Pentahydrate | PH buffer | 1.0 |
| Acid Blue 80 | Colorant | 0.003 |
| Alcohol Ethoxylate, 9EO | Surfactant | 5.0 |
| Chromobond S-100 | Anti-dye transfer agent | 1, 2.5, and 5% |
| Kathon | Preservative | 0.0003 |
| IDS | Chelating agent | 0.1 |
| Perfume | Fragrance | 0.2 |

-continued

| COMPONENT | FUNCTION | WEIGHT % |
|---|---|---|
| Tinofix ECO | Dye fixative | 5.0% |
| Zeolite Water | | To 100% |

Washing Machine Test Conditions:

Kenmore 90 Series
Water level - large
Water temperature - Cold/Cold
One Rinse
Speed - Heavy Duty
Cycle - 14 minute "Ultra Clean"
Tapwater
Clothes:

Direct Red 80 dyed men's socks
White men's socks
8 red socks and 4 white socks per machine
Ballast:

Approximately 1 lb. 100% polyester
Approximately 2 lbs. 100% cotton
Approximately 2 lbs. 50/50 polycotton Adjust the ballast load to obtain a total load weight of 6 lbs.

Dye fading assessment was done as in Example 1 using the above inventive embodiment. Table 6 shows the rank sum scores for comparative and inventive examples on the red, black, and blue men's socks all washed with HDL B.

TABLE 6

| Product | Red socks | Black socks | Blue socks |
|---|---|---|---|
| Comparative | 42 | 39 | 31 |
| Inventive | 45 | 38 | 58 |

The results indicate that the inventive embodiment based on Tinofix ECO demonstrates improvement in anti-fading properties.

EXAMPLE 5

Anti-fading performance of inventive embodiments with varying amounts of CHROMABOND anti-dye transfer agent were tested using direct dyed red men's socks and white socks. The results of this study are shown below in Table 7. Experimental conditions are the same as in Example 4.

TABLE 7

Effect of CHROMABOND levels

| Products | Total Score Red socks | Total Score White socks |
|---|---|---|
| Comparative | 45 | 26 |
| 1% CHROMABOND | 65 | 67 |
| 2.5% CHROMABOND | 73 | 57 |
| 5% CHROMABOND | 67 | 100 |

There is a strong effect of increasing CHROMABOND level on the panelists ranking of the white socks. With regard to the panelist score the red bleeder socks, the effect seems to go through a maximum and then falls off as the level of CHROMABOND increases further.

EXAMPLE 6

The effect of multiple washes with the inventive embodiments on panelists evaluations of the socks was investigated. The Tinofix embodiment was used with direct dyed red and white socks. Panelists ranked the red and white socks versus untreated and unwashed socks after one wash and then after five consecutive washes. The results are summarized in Table 8. Experimental conditions are described in Example 4.

TABLE 8

| | Multiwash effects | |
|---|---|---|
| | 1X wash | 5X washes |
| Red socks | | |
| Comparative | 28 | 32 |
| Inventive with 1% CHROMABOND | 47 | 43 |
| White socks | | |
| Comparative | 49 | 25 |
| Inventive with 1% CHROMABOND | 26 | 50 |

This data shows that there is a somewhat greater cumulative effect on dye transfer after multiple washes for the white socks as compared to the red socks. This could be due to the fact that less dye is bleeding from the red socks as time goes on and thus there is less dye to deposit on the white socks.

EXAMPLE 7

A preferred formulation of the present disclosure is as follows:

| Ingredient | Wt % |
|---|---|
| Zeolite Water of Deionized Water | 50.0–90.0 |
| Alcohol Ethoxylate | 1.0–10.0 |
| Sodium Borate Pentahydrate | 0–0.5 |
| Preservative (i.e. Kathon ®) | 0–1.0 |
| Polyvinylpyrolidone | 0–5.0 |
| Polyvinylpyloidone N-oxide | 0–5.0 |
| Poly(N-carboxymethyl-4-vinylpyridinium chloride) Sodium salt | 0–5.0 |
| Sodium Iminodisuccinate | 0–1.0 |
| Ethylenediamine Tetraacetate | 1–1.0 |
| Cationic Dye Fixative | 1.0–10.0 |
| Perfume | 0–1.0 |
| Dye | 0–1.0 |

Most preferably, the cationic dye fixative is Tinofix® CL, available from Ciba Specialty Chemicals Corporation.

A most preferred formulation is as follows:

| Ingredient | Wt % |
|---|---|
| Alcohol Ethoxylate | 5.0 |
| Sodium Borate Pentahydrate | 0.5 |
| Kathon ® preservative | 0.00003 |
| Poly(N-carboxymethyl-4-vinylpyridinium chloride) Sodium salt | 1.0 |
| Sodium Iminodisuccinate | 0.1 |
| Tinofix ® CL, Cationic Dye Fixative | 5.0 |

-continued

| Ingredient | Wt % |
|---|---|
| Perfume | 0.2 |
| Water | to 100% |

It has been found that if the above formulations are added to the main wash of a clothes washer, along with a typical detergent, colors are inhibited from running and fading. A highly preferred method is to use the above formulations on new clothing.

The foregoing description and examples illustrate selected embodiments of the present invention. In light thereof variations and modifications will be suggested to one skilled in the art, all of which are within the scope and spirit of this invention.

We claim:

1. An aqueous fabric care composition consisting essentially of:

a dye fixing agent;

an N-heterocyclic polymer;

a nonionic surfactant; and optionally a chelating agent, wherein said dye fixing agent is designed to improve the appearance of dyed fabrics by minimizing the loss of dye from fabrics due to washing.

2. The fabric care composition of claim 1 wherein the nonionic surfactant is in the concentration range of about 0.1 to 60 wt. %.

3. The fabric care composition of claim 2 wherein the nonionic surfactant is in the concentration range of about 0.1 to 20 wt. %.

4. The fabric care composition of claim 2 which is buffered to remain in the pH range of about 7 to 8.5.

5. The fabric care composition of claim 1 wherein said dye fixing agent is present in the concentration range of about 0.1 to 20 wt. %.

6. The fabric care composition of claim 5 wherein said dye fixing agent is present in the concentration range of about 1 to 10 wt. %.

7. The fabric care composition of claim 1 wherein said N-heterocyclic polymer is present in the concentration range of about 0.01 to 10 wt. %.

8. The fabric care composition of claim 7 wherein said N-heterocyclic polymer is present in the concentration range of about 0.1 to 5 wt. %.

9. The fabric care composition of claim 1 wherein said chelating agent is present in the concentration range of about 0.001 to 10 wt. %.

10. The fabric care composition of claim 9 wherein said chelating agent is present in the concentration range of about 0.05 to 1 wt. %.

11. The fabric care composition of claim 1 wherein said dye fixing agent is selected from quaternized organic nitrogen compounds and non-quaternized cationic organic nitrogen compounds wherein said compounds further contain amine groups, amide groups or a combination thereof.

12. The fabric care composition of claim 1 wherein said N-heterocyclic polymer is selected from polyvinyloxazolidones, 4-vinyl pyridine polymers, 2-vinyl pyridine polymers, 4-vinyl pyridinium polymers, 2-vinyl pyridinium polymers or mixtures thereof.

13. The fabric care composition of claim 1 wherein said chelating agent is selected from polyaminocarboxylic acids or salts thereof, iminodisuccinate derivatives, phosphonates, citrates, phosphates, and carboxymethyloxy succinate derivatives.

14. A process for pretreating colored fabric with an aqueous treatment composition according to claim 1, said process comprising the steps of contacting said fabric with said composition for a predetermined time before said fabric is washed.

15. The process of claim 14 wherein the concentration of said dye fixative in the aqueous treatment composition is in the concentration range of about 0.0008 to 0.16 wt. % and the N-heterocyclic polymer is in the concentration range of about 0.00008 to 0.08 wt. %.

16. The process of claim 15 further comprising treatment with a chelating agent wherein the concentration of said chelating agent in the aqueous treatment composition is in the concentration range of about 0.00004 to 0.04 wt. %.

17. The process of claim 16 wherein the aqueous treatment composition has a pH range of about 7.0 to 8.5.

18. A process for washing colored fabrics simultaneously with a detergent solution, and a composition according to claim 1, said process comprising the steps of adding said composition into said detergent solution, said detergent solution having a concentration of surfactants in the range of about 1.0 to 0.08 wt %.

19. The process of claim 18 wherein said surfactants includes one or more anionic surfactants, said anionic surfactants being collectively present in the range of about 0.0046 to 0.065 wt % in said detergent solution.

20. The process of claim 19 wherein the pH of said detergent solution is in the range of about 7.0 to 9.5.

21. The process of claim 18 wherein the concentration of said dye fixative in said detergent solution is in the concentration range of about 0.0001 to 0.02 wt. % and the N-heterocyclic polymer is in the concentration range of about 0.00001 to 0.01 wt. %.

22. The process of claim 18 further comprising treatment with a chelating agent wherein the concentration of said chelating agent in the detergent solution is in the concentration range of about 0.000005 to 0.005 wt. %.

* * * * *